United States Patent [19]

Wilham et al.

[11] Patent Number: 4,594,481

[45] Date of Patent: Jun. 10, 1986

[54] ELECTRONIC TOUCH PAD KEY ASSEMBLY WITH STROKE AMPLIFIER

[75] Inventors: Donald W. Wilham; Richard A. Rowe, both of Louisville, Ky.

[73] Assignee: General Electric Company, Louisville, Ky.

[21] Appl. No.: 746,528

[22] Filed: Jun. 19, 1985

[51] Int. Cl.[4] ..... H01H 3/12

[52] U.S. Cl. ..... 200/5 A; 200/295; 235/145 R

[58] Field of Search ..... 200/5 A, 293, 295, 159 B, 200/340; 235/145 R

[56] References Cited

U.S. PATENT DOCUMENTS

| | | | |
|---|---|---|---|
| 3,133,170 | 5/1964 | Nanninga | 200/67 DB |
| 4,127,752 | 11/1978 | Lowthorp | 200/5 A |
| 4,360,722 | 12/1982 | Georgopulos | 200/159 B X |

*Primary Examiner*—A. D. Pellinen

*Assistant Examiner*—Morris Ginsburg

*Attorney, Agent, or Firm*—Frank P. Giacalone; Radford M. Reams

[57] ABSTRACT

An electrical switch panel including a switch actuating assembly is disclosed for intermittently altering the electrical condition of a switch. A base member is formed to include a plurality of chambers each dimensioned for receiving and retaining the electrical switch actuating assembly is positioned on a support member carrying the switch. An insulative tactile film is arranged on the base pad providing a touch area covering the chamber openings. An axially movable member disposed in the chamber is operable by movement of the film to engage a cantilever switch actuating member whereby the axial movement of the film transmitted through the axially movable member causes an amplified movement of the cantilever switch actuating member which is effective in altering the electrical condition of the switch.

5 Claims, 7 Drawing Figures

FIG. 7
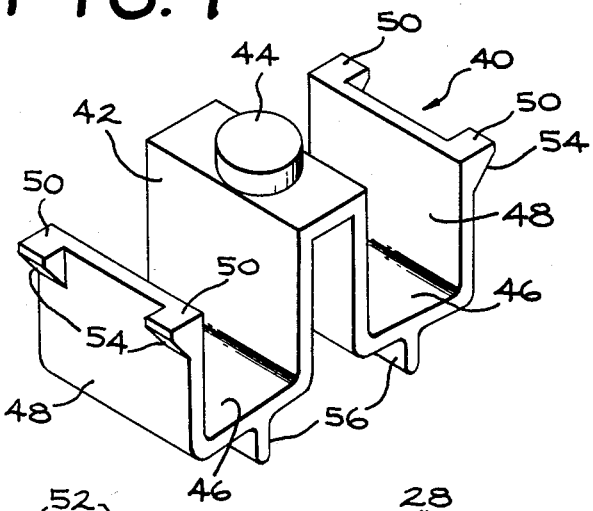
FIG. 4
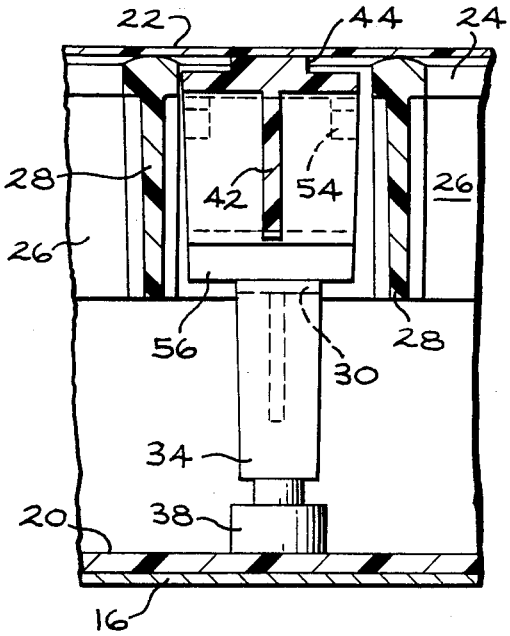
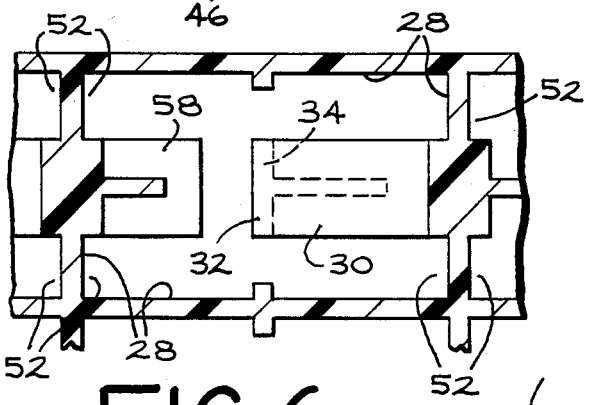
FIG. 6
FIG. 5
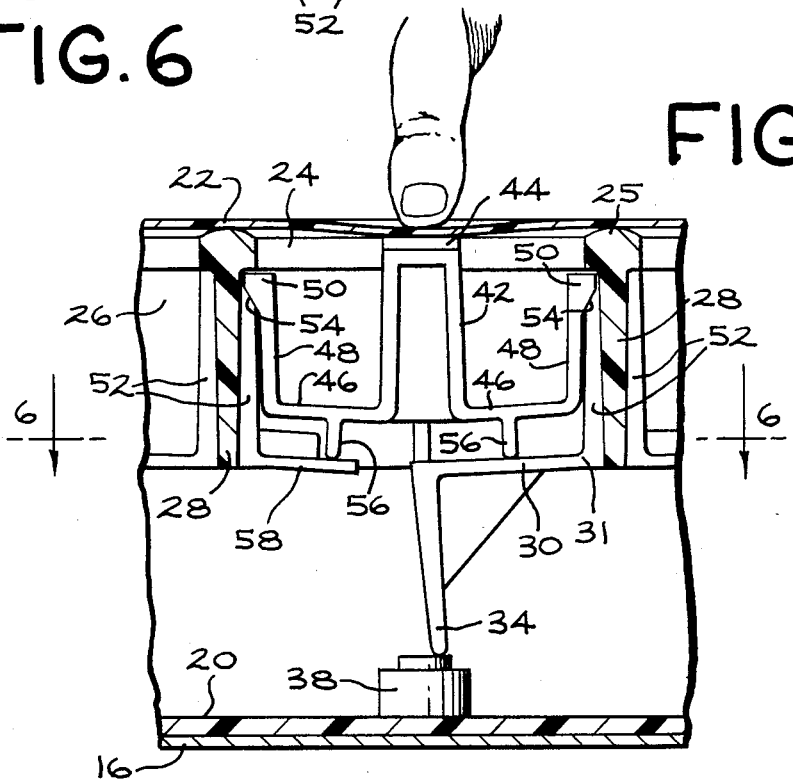

ELECTRONIC TOUCH PAD KEY ASSEMBLY WITH STROKE AMPLIFIER

BACKGROUND OF THE INVENTION

This invention relates generally to electrical switch panels and more particularly to a switch panel wherein a switch actuating assembly is provided wherein a slight depression of cover layer with a finger is amplified to operate a switch located in spaced relation to the switch actuating assembly.

In one type prior art switch panel construction wherein the switch assembly is covered by an insulative film, the film defines a plurality of points or areas which may be depressed to actuate a switch associate with the particular area. Usually two electrodes are built into the switch panel which in their normal or steady state are not connected, that is there is no conductive path between them.

In operation when an area is depressed one of the conductive strips is also depressed to urge it in position to establish a conductive path between electrode for a brief period. While switches of this type have provided satisfactory performance they have certain disadvantages. The disadvantages reside in the cost of the assemblies, the tolerances required and the fact that a switch assembly must be designed for each application since each switch is an integral part of the total switch assembly. Further since this type of switch assembly is designed to be contacted by the user the switch must meet stringent safety guidelines with regard to electrical integrity, exposure to high temperatures, and also tolerance to humidity and moisture protection.

By the present invention a switch panel construction is provided wherein the film which defines a plurality of points or areas which may be depressed to actuate a switch is part of switch actuating assembly which includes a switch actuating member. The switch actuating assembly while part of the switch panel is nevertheless a separate module thereof. The switch panel as assembled includes the switch actuating assembly and a switch carrying member which is spaced therefrom. In order to insure that the appropriate switch will be actuated by a slight depression of a corresponding area in the film the switch actuating assembly is provided with means for amplifying this slight depression of the film. This arrangement allows a great degree of tolerance between the film layer and the switch since the amplified movement of the film transferred by the switch actuating assembly is in fact greater than that needed to actuate the switch. The fact that this arrangement permits the electricity carrying board incuding the switch to be remote from the user operated film a different and lower level of requirements are imposed on the assembly regarding electrical integrity, high temperature, and moisture protection.

SUMMARY OF THE INVENTION

One object of the present invention is to provde a switch panel assembly having a tactile feedback to the user, and a stroke amplification for increased tolerance absorption between switches which are mounted so as to prevent direct contact with a user appearance interface film.

Another object of the invention is to provide a switch actuating assembly which is not electrically connected to the switches being activated.

Still another object of the invention is to provide a switch actuating assembly which is removably associated with the switches.

In an electrical switch panel assembly a switch actuating assembly is provided which is operable for intermittently altering the electrical condition of a switch arranged in a switch carrying electrical board member. The switch panel assembly is mounted in a support member including a top wall and a bottom wall which supports the switch carying board member.

A base member is arranged on the top wall of the support member. The base member includes an opening defining a chamber. The chamber includes side walls extending from the opening and a bottom wall defined by a cantilever extending from one of the side walls to a centrally located free end. The free end includes a switch actuating portion positioned adjacent a switch mounted on board member. An insulative film is positioned over the base member to provide a touch area covering the chamber opening. Disposed for axial movement in the chamber is an actuator member. The actuator member includes a subtending leg which is positioned to engage the cantilever intermediate the free end and the side wall. This arrangement allows slight axial movement of the film which is transmitted through the actuator means, cantilever to be amplified as the switch actuating portion alters the electrical condition of the switch.

DESCRIPTION OF THE DRAWINGS

FIG. 4 is a cross-sectional view taken along line 4—4 of FIG. 3;

FIG. 5 is a sectional view similar to FIG. 3 showing the parts in an operative position;

FIG. 6 is a fragmentary plan view taken along line 6—6 of FIG. 5 showing certain details of the invention; and FIG. 7 is a perspective view of the switch actuator member incorporated in the present invention.

DESCRIPTION OF THE PREFERRED EMBODIMENT

Figure 1:
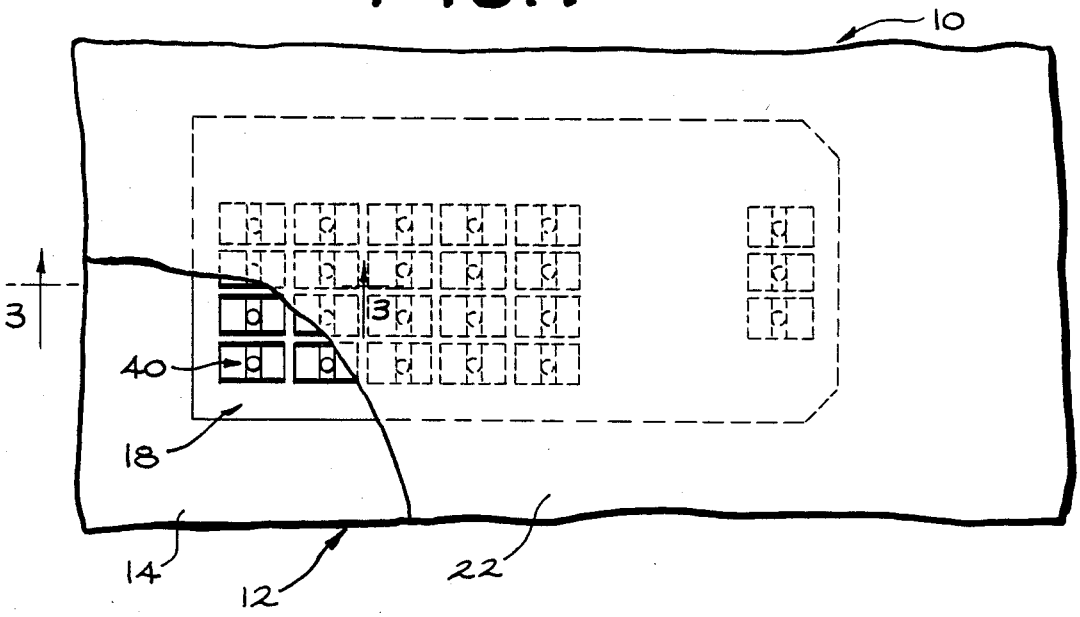
FIG. 1 is a plan view of an electrical switch panel incorporating the present invention.
Figure 3:
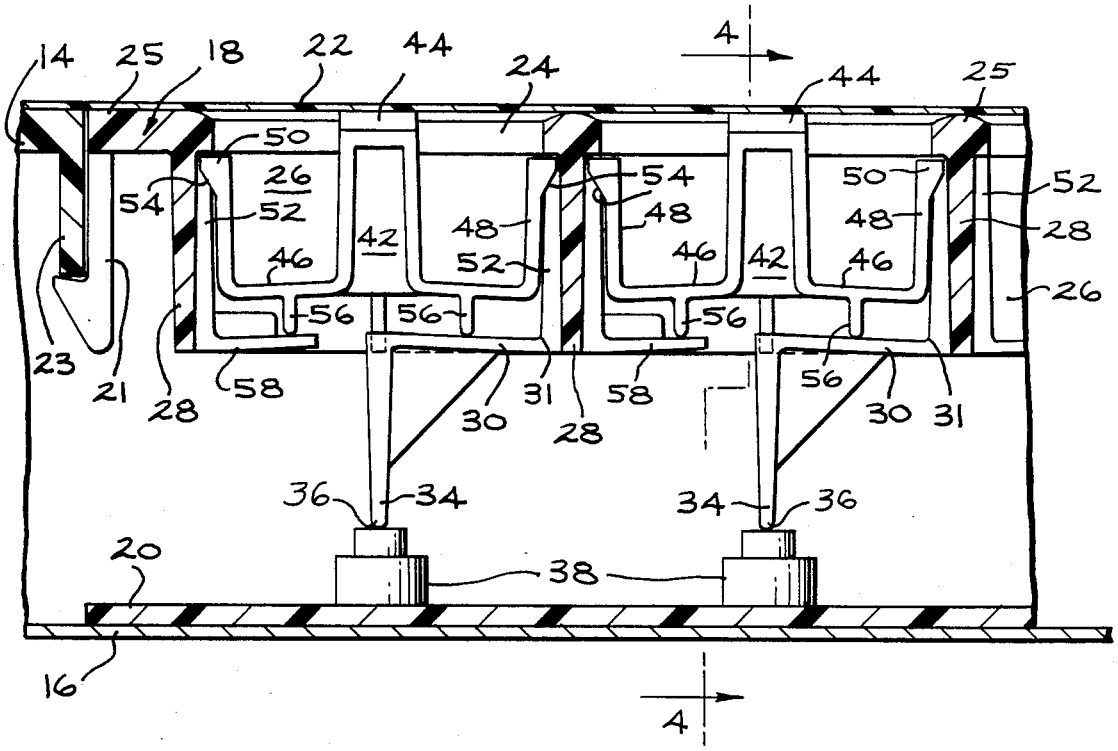
FIG. 3 is a cross-sectional view taken along line 3—3 of FIG, 1.
Figure 2:
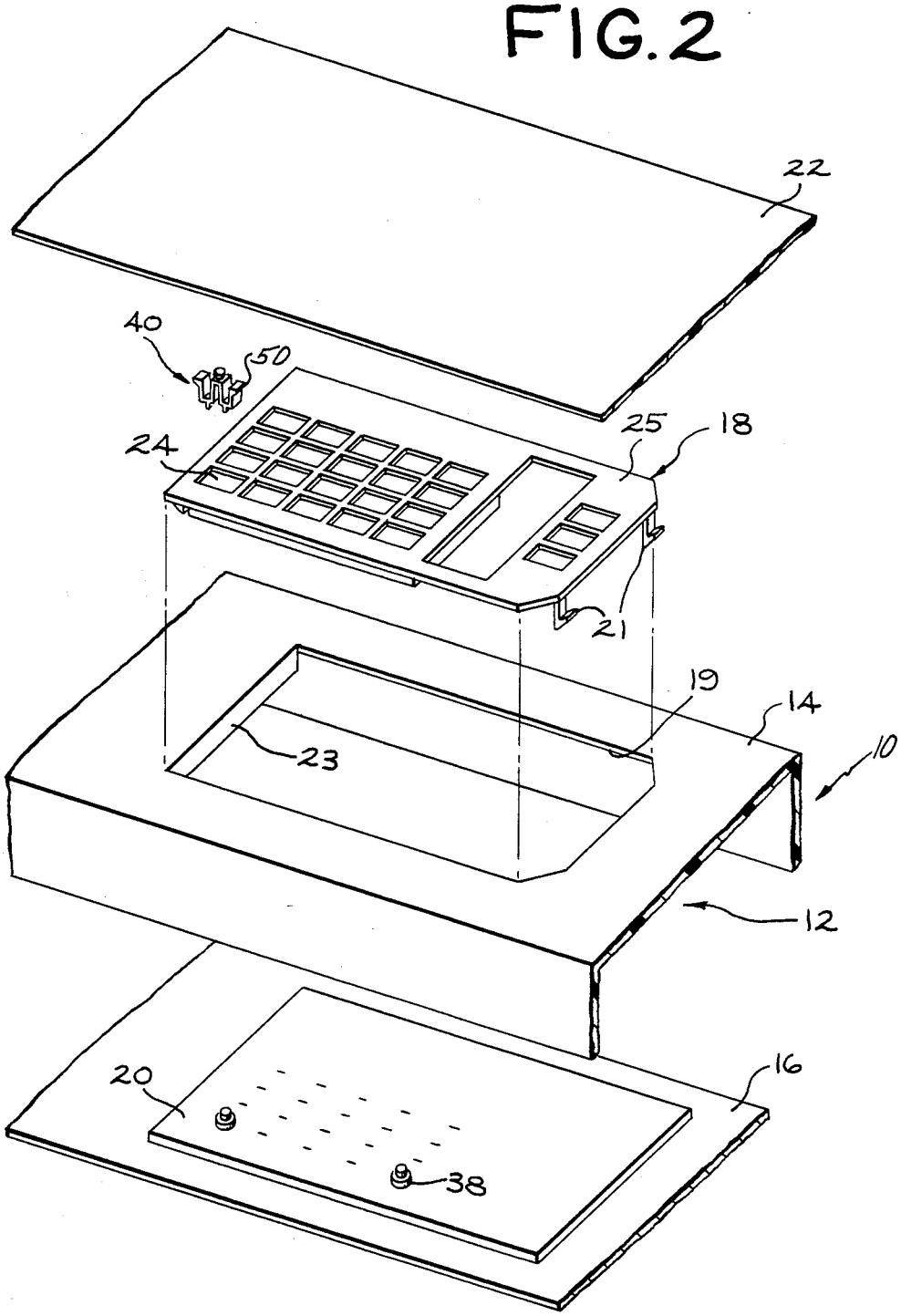
FIG. 2 is an exploded perspective view showing the sub component of electrical switch panel of FIG. 1.

Referring now to the drawing and more particularly FIGS. 1–3 there is shown an electrical switch panel assembly which includes a support structure 12 having a top wall 14 and a bottom wall 16. The switch panel defines an arrangement of four rows and five columns of switch positions (FIG. 1) which is intended to be illustrative and not limitive in that the panel may include a greater or lesser number of switch positions than actually illustrated.

The switch assembly includes a base member 18 mounted on the top wall 14, a switch carrying electrical panel 20 mounted on the lower or bottom wall 16, and an insulating film layer 22 which may be a thin flexible, decorative plastic sheet having appropriate designations printed thereon for each of the switch positions. The member 18 is arranged in an opening 19 formed in the wall 14. The member 18 is removably secured to the wall 14 as shown in FIG. 2 and 3 through a plurality of depending hook-like member 21 which snap under the lower edge of a cooperating wall section 23. Removal of member 18 from wall 14 permits access to the panel 20. The base member 18 as will be fully explained hereinafter is the switch actuating portion of the switch assembly. The switch carrying panel 20 is fabricated from insulating material. Mounted on the panel 20 are a plurality of temporary make switches 38 which are to be activated by the present invention. The panel 20 may further include appropriate conductive circuitry (not shown). Accordingly, by the present invention the switch actuating portion of the switch panel does not carry nor is connected to any of the electrical components of the switch panel.

With reference to the base member 18 as shown in FIGS. 1-5 each of the switch positions includes an opening 24 in the surface or top wall 25 of member 18. Each opening 24 defines a chamber 26. The chambers 26 are further defined by four depending side walls 28 extending from the top wall 25. Extending outwardly from the lower edge of one of the side walls 28 in each chamber 26 is a cantilever 30. The cantilever 30 extends to a generally centrally located free end 32 as shown in FIG. 6. A switch actuating member 34 extends downwardly from the free end 32 of cantilever 30. As shown in FIGS. 3-5 the lower end 36 of member 34 is positioned adjacent a switch 38 mounted on the panel 20.

Arranged for axial movement in the chambers 26 is an actuating member 40 (FIG. 7). The member 40 is generally W-shaped and includes a central portion 42 which includes an upper end 44 positioned in close proximity to each switch position in the film layer 22. Extending outwardly from each side of the central portion 42 are guide portions each including a lower wall portion 46 generally perpendicular to portion 42 and an upwardly extending wall portion 48 generally parallel with the portion 42. The upper ends of each wall portion 48 includes a pair of outwardly projecting ears or guides 50. The guides 50 are dimensioned to be received in a groove 52 formed in opposed side walls 28 of chamber 26. The grooves 52 extend from the lower edge of opposite walls 28 to a position adjacent the walls 25 of member 18. The projecting guides 50 are formed to include an incline or cam surface 54 extending downwardly form the distal end of guide 50 back to the wall 48. During assembly as the actuating member 40 is inserted into the chamber 26, the cam surface 54 engages the chamfered peripheral edge of the opening 24. This interaction between cam 54 and the edge of opening 24 causes the wall portions 48 to flex inwardly toward the center portion 42 thereby allowing the projecting guides 50 to pass through opening 24. Once the guides pass the opening 24, the wall 48 restores to its normal configuration and the guides 50 move into the grooves 52 as shown in the drawings. Since the grooves 52 do not extend through the opening 24, the guide 50 and groove 52 arrangement not only serve to guide the member through its axial movement, but further acts to retain the member 40 in the chamber 26.

Projecting downwardly from each of the lower wall portions 46 is a subtending leg member 56. The actuating member 40 is supported in the chamber 26 by virtue of one of the legs 56 resting on the cantilever 30 extending from one side wall 28 and the other of the legs 56 resting on the shorter arm 58 extending from the opposite wall 28 as shown in FIGS. 3 & 5.

In operation when a switch area on film 22 is depressed, the actuator 40 moves axially downwardly the same distance. This downward movement of the actuator 40 is transferred to the cantilever 30 through its associated leg 56. As best seen in FIG. 5, the cantilever 30 in fact pivots about a point 31 which is at its junction with the wall 28. Accordingly, the axially downward movement of switch actuating member 34 by virtue of the location of leg 56 on the cantilever 30 movement of the free end of the cantilever is amplified. In the present instance the amplification of axial movement between the film and member 34 to the free end of cantilever 30 and accordingly is approximately one to three.

In summary a switch assembly is provided by the present invention wherein because of the amplification of the axial movement of the film a great latitude is allowed in the assemblying of the switch assembly. As mentioned hereinbefore, since the amplified axial movement of member 34 is greater than that required to actuate the switch 38, the distance between the film 22 and the switch 38 may vary without having a negative impact on switch operation. Further this allows a less stringent requirement to be imposed on the structure regarding electrical isolation of the switch panel since all of the electricity-carrying components are spaced from the operator touch portions of the assembly.

It should be apparent to those skilled in the art that the embodiment described heretofore is considered to be the presently preferred form of this invention. In accordance with the Patent Statues, changes may be made in the disclosed apparatus and the manner in which it is used without actually departing from the true spirit and scope of this invention.

What is claimed is:

1. An electrical switch panel including a switch and a switch actuating assembly positioned for intermittently altering the electrical condition of said switch comprising:

a support member including a top wall supporting said switch actuating assembly, and a bottom wall for supporting said switch;

a base member arranged on said top wall in spaced relationship to said bottom wall, said base member including an opening defining a chamber;

an insulative film arranged on said base member providing a touch area covering said chamber opening;

actuating means disposed for axial movement in said chamber, and a movement amplifying lever arrangement in said chamber, whereby axial movement of said film is transmitted through said actuating means and said movement amplifying lever arrangement to thereby amplify said axial movement of said film to alter the electrical condition of said switch.

2. The electrical switch panel recited in claim 1 wherein said chamber includes side walls extending from said opening and a bottom wall defined by a cantilever extending from one of said side walls to a centrally located free end, a switch actuating member extending downwardly from said centrally free end of said cantilever having its lower end located adjacent said switch on said bottom wall of said support member.

3. The electrical switch panel recited in claim 2 wherein said actuating means includes a central portion having its upper end arranged adjacent said insulative film, lower wall portions extending outwardly from said central portion and upwardly extending side wall portions spaced from said central portion.

4. The electrical switch panel recited in claim 3 wherein said actuating means includes a subtending leg means on said lower wall portions engaging said cantilever intermediate said centrally located free end and said one of said side walls, whereby axial movement of said film is transmitted through said actuating means and said cantilever to thereby amplify said axial movement of said film to cause said actuating member to alter the electrical condition of said switch.

5. The electrical switch panel recited in claim 4 wherein the upper end portions of said side wall portions of said switch actuating means includes means projecting outwardly therefrom dimensioned to engage guide means in said chamber side walls for axially retaining said actuating means in said chamber.

* * * * *